US011033451B2

(12) United States Patent
Schreier et al.

(10) Patent No.: US 11,033,451 B2
(45) Date of Patent: Jun. 15, 2021

(54) BALANCE AND WALKING TRAINER

(71) Applicant: KB Balance Products, Inc., Rapid City, SD (US)

(72) Inventors: Barbara Jo Schreier, Rapid City, SD (US); Gary E. Schreier, Rapid City, SD (US); Raymond C. Clark, Rapid City, SD (US)

(73) Assignee: KB Balance Products, Inc., Rapid City, SD (US)

( * ) Notice: Subject to any disclaimer, the term of this patent is extended or adjusted under 35 U.S.C. 154(b) by 156 days.

(21) Appl. No.: 15/434,380

(22) Filed: Feb. 16, 2017

(65) Prior Publication Data

US 2018/0228685 A1 Aug. 16, 2018

(51) Int. Cl.
*A61H 3/04* (2006.01)

(52) U.S. Cl.
CPC ..... *A61H 3/04* (2013.01); *A61H 2003/046* (2013.01); *A61H 2201/0192* (2013.01); *A61H 2201/1261* (2013.01)

(58) Field of Classification Search
CPC ..... A61H 3/04; A61H 2003/046; A61H 2201/0192
See application file for complete search history.

(56) References Cited

U.S. PATENT DOCUMENTS 885,977 A * 4/1908 Brown ..... B62B 3/007 188/21
1,972,557 A * 9/1934 Greene ..... A61G 5/00 297/5
3,976,152 A * 8/1976 Bell ..... A61G 5/042 180/9
5,364,120 A * 11/1994 Shimansky ..... A61G 5/00 280/47.2
5,390,753 A * 2/1995 Parker ..... A61G 5/045 180/19.1
5,538,268 A * 7/1996 Miller ..... A61H 3/04 280/87.041
5,964,473 A * 10/1999 Degonda ..... A61G 5/043 180/907

(Continued)

*Primary Examiner* — Christopher R Harmon
(74) *Attorney, Agent, or Firm* — Jeffrey A. Proehl; Woods, Fuller, Shultz & Smith, P.C.

(57) ABSTRACT

A Balance and Walking Trainer for improving the ability to walk, particularly for relearning to walk, which includes a base frame, three pairs of wheel casters, one front pair, one center pair aligned centrally with the user, and one rear pair, which is smaller in diameter than the front and center pairs and which floats above the ground. The Balance and Walking Trainer further comprises two pairs of telescoping risers affixed essentially vertical and also perpendicular to the base frame, wherein the first pair of telescoping risers are aligned substantially with the center wheels. In order for correct body mechanics to be maintained, a user may "scoop" his hands onto the handles to operate the Balance and Walking Trainer with correct body mechanics. The second pair of telescoping risers is aligned posterior to the first telescoping risers and a U-shaped bumbar is releasably attached to provide structure and stability to the Balance and Walking trainer and to provide a seat for the user or to provide a means to catch the user if user should fall backwards while operating the invention.

16 Claims, 3 Drawing Sheets

(56) References Cited

U.S. PATENT DOCUMENTS

| | | | | |
|---|---|---|---|---|
| 6,343,802 | B1 * | 2/2002 | Workman | A61H 3/008 135/67 |
| 6,607,202 | B1 | 8/2003 | Palmer | |
| 6,666,222 | B1 * | 12/2003 | Fattahi | A61H 3/04 135/67 |
| 7,938,756 | B2 | 5/2011 | Rodetsky et al. | |
| 8,663,136 | B1 | 3/2014 | Alsaffar | |
| 9,022,397 | B1 | 5/2015 | Prettyman | |
| 9,180,066 | B2 | 11/2015 | Izard et al. | |
| 2002/0074747 | A1 * | 6/2002 | Heien | B60B 19/12 280/5.26 |
| 2009/0050187 | A1 * | 2/2009 | Lamb | A61H 3/04 135/67 |
| 2010/0170546 | A1 | 7/2010 | Popovic et al. | |
| 2010/0263697 | A1 * | 10/2010 | Catton | A61H 3/04 135/67 |
| 2017/0014298 | A1 * | 1/2017 | O'Sullivan | A61H 3/04 |
| 2018/0207050 | A1 * | 7/2018 | Hamilton | A61H 3/04 |

* cited by examiner

BALANCE AND WALKING TRAINER

TECHNICAL FIELD

The present invention relates generally to exercise or training devices and more specifically to training devices designed to improve the availability and capability for mobility and walking for users challenged with mobility issues stemming from disease, injury, surgery and/or aging. In addition to providing comfortable mobility, the device stimulates an anatomically correct posture and provides the opportunity for repetitive and rhythmic gait.

BACKGROUND OF THE INVENTION

Millions of people around the world are challenged with mobility issues. Mobility challenges may be temporary or long-term in nature. Temporary challenges result from events such as hip/knee replacement (1 million/year in the US) and lower body injury or lower limb amputation (1.7 million/year in the US). In such cases the present invention speeds the mending process, where as other mobility devices only provide a tool to lean on. Long-term mobility challenges stem from neurological disorders such as Parkinson's Disease (PD) and Multiple Sclerosis (MS) (1.4 million in the US), traumatic spinal column injuries (275K/year in the US), stroke (800K/year in the US) and aging (8.5 million in the US). These mobility issues are highly variable. In such cases the present invention enhances the retraining for mobility by providing a feeling of security while stimulating an anatomically correct posture and initiating an even and rhythmic walking gait. The instant invention can significantly improve the quality of life of an estimated 11 million people in the US alone.

There are generally three categories of devices in use addressing mobility challenges. These are: anterior, stationary and posterior devices. Anterior devices included devices such as the traditional "walker" where the user is behind the device. Typically these devices have four legs with zero, two or four wheels attached. Said devices are mobility enablers providing security and mobility. Users typically lean into the device using the device for support. Although such anterior devices have proven to be very useful for thousands of people, they are not intended to provide training to ultimately improve walking ability nor to aid in relearning to walk. Stationary devices consist of devices such as parallel bars, treadmills and stationary bicycles. Said devices generally focus toward strength training. Building sufficient strength to support one's body weight is a critical first step in the mending process. Said devices however do not target an anatomically correct posture with an even and rhythmic walking gait. Posterior devices include the present invention and other gait trainers. Said devices are behind and/or around the user leaving the forward facing user with nothing to his front. These devices focus on training as well as mobility. Some of these devices incorporate a means to support body weight through design of the handle bar or use of a harness or similar load bearing device. Said devices typically have four legs with attached wheels that may or may not swivel.

The instant invention is of unique design that stimulates both an anatomically correct and balanced posture with an even rhythmic walking gait. There are at least three components that are unique to the instant invention. First is the placement of the center wheel, the second is the capability of the user to be able to scoop his arms or hands rather than push his arms or hands onto the device, and the third is the elevation of the rear wheels off the ground.

The instant invention's placement of a centered wheel inherently invites the user's shoulders back and hips forward, thus aligning the user's center of gravity through his hips. This transfers the user's weight through the body as opposed to through the device in other training devices. This is accomplished by aligning the user's body with the device's center wheels. This causes the user to support his own weight and balance himself as opposed to using the device to support weight.

The second unique component of the instant invention is the capability of the user to be able to scoop his arms or hands rather than push his arms or hands into the device. The present invention wraps behind the user and thus immediately cancels the need to lean forward. With training and brief practice, the user learns to scoop, not lean into the handlebars. The user pushes down onto the handlebars to lift up his trunk. This scooping encourages upright posture. The responsive movement of the center wheel to the motion of the user moving upright is what permits the user to find and maintain anatomically correct and effective posture. The inherent uniqueness of this instant invention stimulates an anatomically balanced correct posture resulting in a rhythmic walking gait. The present invention offers the best capability for rhythmic gait to occur in the user.

The third unique component of the instant invention is the elevation of the rear wheels off the ground. In the present invention, the rear wheels are of smaller size than the center and front wheels and are elevated approximately one and one half inches above the ground. When the device is in operation, the rear wheels do not contact the ground and essentially float above the ground. This is essential to permit the Center Wheels to roll in response to the user's body becoming upright, allowing correct body mechanics for walking. No other device allows for this freedom of movement. If the center wheels are not permitted to roll forward, the user cannot push his body upright to walk with property body mechanics. The raised rear wheels allow for the instant invention to navigate stairs and provide a safety mechanism if the user were to fall backwards onto the instant invention.

There are a great number of "walkers" available for sale. A number of conventional walkers are tall stands with 4 small wheels on the bottom. The user leans on the device and pushes it ahead of himself. It helps provide some balance and security. These conventional walkers are intended to provide support and are not intended to provide training to improve walking ability nor to promote proper posture alignment as the instant invention does. Most people who use a conventional walker never improve. Whatever causes walking difficulties is likely to remain status quo or to worsen. For the aged who use a walker for fall prevention, the walker requires leaning forward, which eventually increases fall risk.

The instant invention works just the opposite of a conventional walker in most ways. A user of the instant invention pushes himself upright into proper posture for walking, rather than leaning on the device as is required by conventional walkers. This upward push begins to illicit the proper chain of body mechanics for walking. The preferred embodiment of the device has six wheels, three on each side, with the front and center wheels always riding on the ground while walking. The back wheels are situated above the ground. They are used to bring the instant invention to a sitting position and posture as well as aid in negotiating stairs and curbs. Because the rear wheels are not on the ground except for sitting or stepping, the center wheels, which are situated to be directly below the user's hip, can move forward slightly when the user pushes himself upright. The instant invention is the only device to have a center wheel in alignment with the user's hips. This relationship is key to allowing the user to prevent leaning by shifting his weight. This is what stimulates the leg to swing forward and initiates walking. The wheels of the conventional walker are all on the ground simultaneously and are used only to allow the walker to roll in response to being pushed. They do not have any interplay with the body mechanics of the user. In the instant invention, the critically placed center wheels and the critical distance of the handles from the body and the critical angle of the bend of the handles all interplay with the body to stimulate the correct body mechanics for walking. This can only happen because the floating rear wheels give freedom to the center wheels to roll forward as the body rocks back into a correct walking posture. The instant invention is also simple, safe, decreases mending time for lower limb injuries and surgeries; and is a training device and mobility aid for some neurological patients with mobility impairment and for the aged. It also serves as a diagnostic tool for physical therapists because a user is able to slow his pace safely which allows weaknesses to be more easily discerned. Once the skills of using the said invention are learned, it is pleasant to operate and it is also easy to maintain.

SUMMARY OF THE INVENTION

The Balance and Walking Trainer of the instant invention includes two pairs of three wheels affixed to base frames, which are aligned on the left and right sides of the user. The front and center wheels are larger than the back wheels. The back wheels ride above the ground during walking. The back wheels are used for sitting or for negotiating stairs. Affixed perpendicularly to the base frames approximately above with the center wheels are two sets of vertical, telescoping risers welded to the base frames. On each side of the present invention, one telescoping riser is positioned directly in alignment with the center wheels and another telescoping riser is attached posteriorly to the first telescoping riser. The handle bars are attached to the tops of these anterior riser inserts. Directly behind the center wheels are telescoping risers to which the bumbar is attached. The bumbar is a U-shaped piece that connects and stabilizes the two sides of the said invention. The bumbar wraps behind the user, thus keeping the front of the device open for freedom of movement. The handle bars extend horizontally forward from the riser inserts and are equipped with rubber handle grips at the ends. Braking levers are affixed directly under the handles which, when engaged, activate brakes affixed to the center wheels.

A user stands in front of the bumbar and facing the opening with his hips centered over the center wheels. He places his hands onto the handles and presses (scoops) down into the handle bars to press his upper body up over his hips into an upright posture. The functionality of this is based on Newton's $3^{rd}$ Law of Motion: For every action there is an equal and opposite reaction. This technique is learned with a little practice. The motion of the trunk coming upright and back acts to rock the user's pelvic girdle forward which stimulates the leg to swing forward to begin walking. As the user continues to walk he continues to scoop into the handles to continue to stimulate the mechanics for walking.

Those suffering from neurological disorders or injuries that impair their walking immediately find that they can walk rhythmically and thus retrain their gait. Walking that has been neurologically impaired requires rhythmic and repetitive motion in order for rewiring new neuropathways. The instant invention is purposed for this.

Those recovering from injuries or surgeries to the lower back or lower limbs are able to distribute varying amounts of their weight through their arms, as they stand and move in an upright posture. This allows them to reduce the stress and consequent pain to the mending area. The instant invention is designed to assist in pain management and to decrease the amount of recovery time.

For the aged, the instant invention allows the user to come upright or to begin to re-strengthen the muscles to reclaim an upright posture. This greatly enhances the aged user's self-esteem and decreases fall risk which is increased by devices that require the user to lean forward on to it. The instant invention is designed to bring a higher quality of life and greater safety to the aged.

In addition to being a training and walking aid to these three groups of users, the instant invention serves as a diagnostic tool for physical therapists. Because the user can slow his gait without fear of falling, small inaccuracies can be discerned that cannot be detected at regular gait. It inherently positions the user in a posture that strengthens him to prevent falls.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

REFERENCE NUMERALS

| | |
|---|---|
| Base Frame | 110 |
| Front Wheel Caster | 112 |
| Center Wheel Caster | 114 |
| Rear Wheel Caster | 116 |
| Bumbar | 118 |
| Brake Cable | 120 |
| Posterior Telescoping Insert | 122 |
| Handle | 124 |
| Brake Lever | 126 |
| Fastening Nut | 128 |
| Aneterior Telescoping Insert | 130 |

DETAILED DESCRIPTION OF INVENTION

Figure 1:
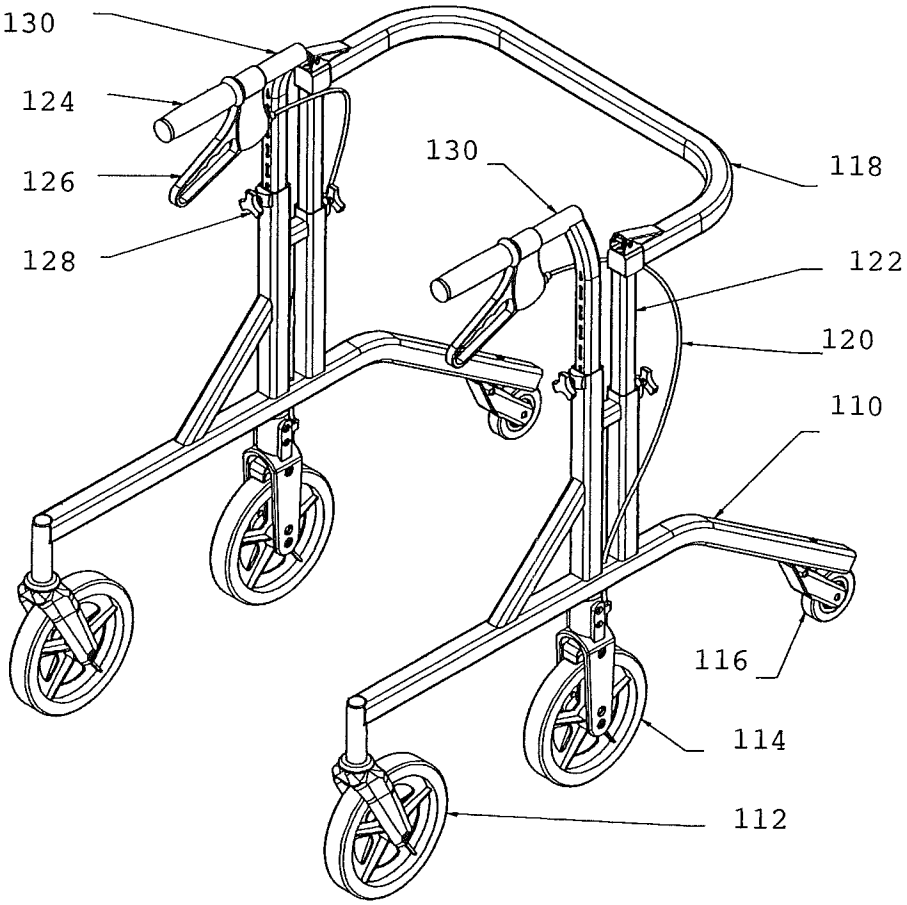
FIG. 1 is a perspective view of the present invention, showing the Balance and Walking Trainer set in an operative condition.
Figure 2:
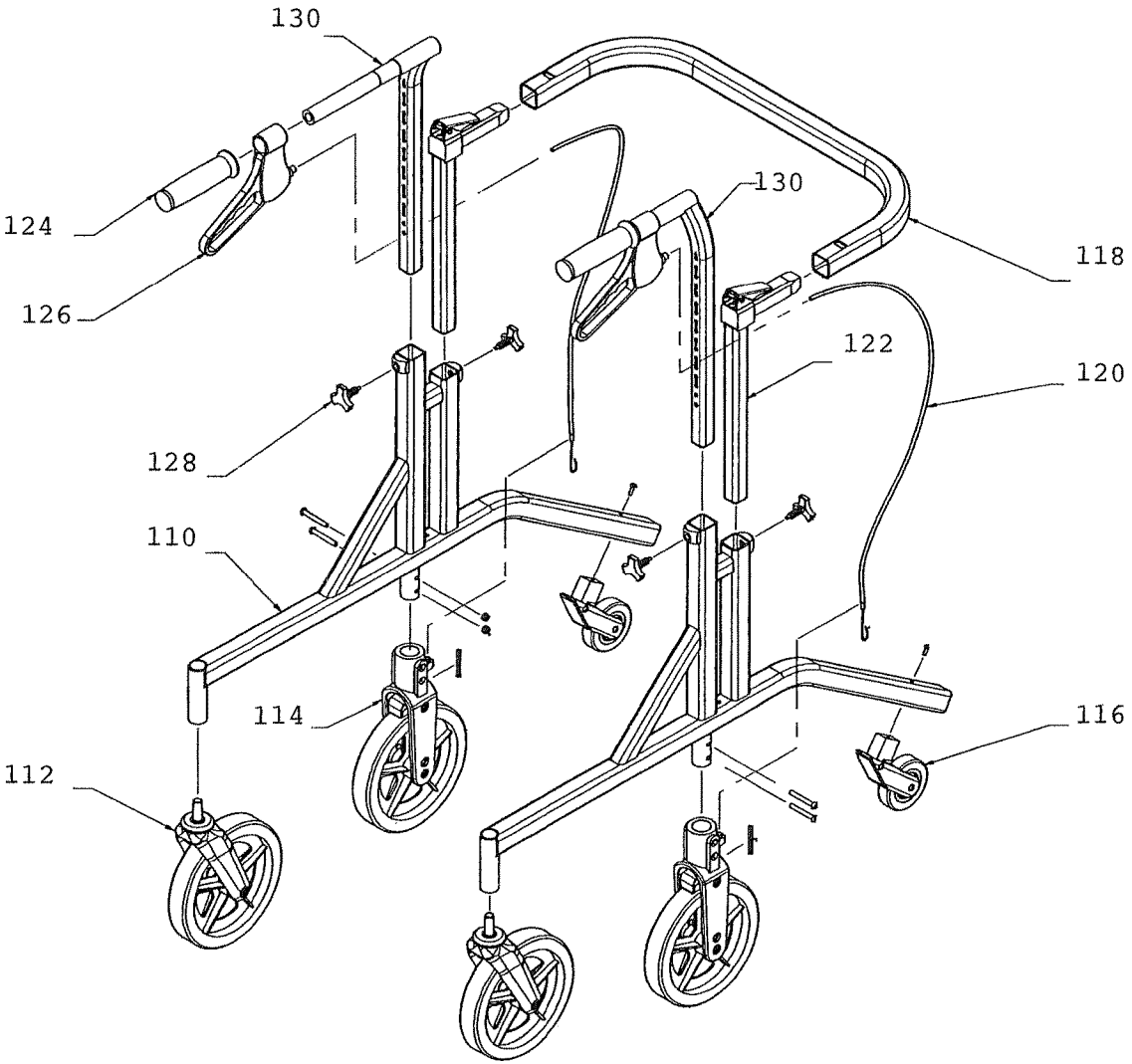
FIG. 2 is an exploded view of the present Balance and Walking Trainer.
Figure 4:
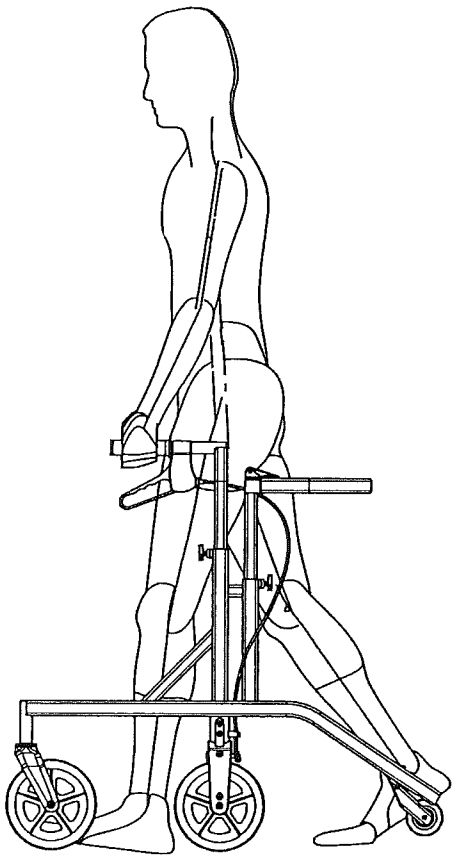
FIG. 4 is an applied view of the present Balance and Walking Trainer showing the left side of the present invention.
Figure 3:
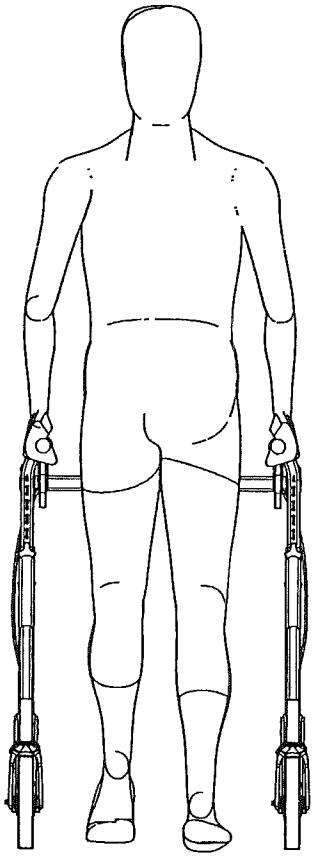
FIG. 3 is an applied view of the present Balance and Walking Trainer showing the front of the present invention.

Referring to FIG. 1, a preferred embodiment of the instant invention is shown. The intended direction of a user's movement is considered to indicate the forward end of the device. Referring to FIG. 4, a Left Side View shows a side view of the instant invention. A Base Frame 110 is provided to attach the a Front Wheel Caster 112, a Center Wheel Caster 114, and a Rear Wheel Caster 116. The present embodiment of the invention has two Base Frames 110, one of which is situated to the left of the user and one which is situated to the right of user during normal operation of the invention. Each Base Frame 110 is constructed identically and are supportably connected to each other to form the present invention as shown in FIG. 1. The Base Frame 110 in the present embodiment of the invention is constructed from a rigid tube which forms the base and provides form and structure to the invention. In the present embodiment of the invention, said Frame 110 is constructed from tubular aluminum. A Front Wheel Caster 112 is rotatably mounted to the inferior plane of the Base Frame 110 at or near the anterior end of the Base Frame 110. The rotation of the Front Wheel Casters 112 allow the present invention to be steered by the user. A Center Wheel Caster 114 is mounted to the inferior plane of the Base Frame 110 approximately in line with the user's hips during operation of the invention. A Rear Wheel Caster 116 is mounted to the inferior plane of the Base Frame 110 at or near the posterior end of said Base Frame 110. In the present embodiment of the invention, the said Rear Wheel Casters 116 are affixed 17.0 inches from the center of the said center braked caster 116 to prevent tipping backwards. In the preferred embodiment the said Rear Wheel Casters 116 are three inches in diameter. The posterior thirteen and three-quarter inches of the said Base Frame 110, which is the portion of said Base Frame 110 posterior to the attachment site of the Center Wheel Casters 114, is bent downward so as to suspend the Rear Wheel Caster 116 at approximately one and a half inches above the ground considering the height and diameter of the Front Wheel Casters 112 and Center Wheel Casters 114. This specific distance is to allow the said Rear Wheel Casters 116 to essentially float above the ground, which gives the Center Wheel Caster 114 complete freedom to respond to the movement of the user pushing into an upright posture. If all three sets of wheels contacted the walking surface, as are shown in the prior art, the Center Wheel Casters 114 will not spontaneously roll forward in response to the user's chest rising upwards and backwards over the user's hips. The devices present in the prior art prohibit the user from becoming fully upright and predisposes users to walking failures. The advancements in the present invention allows the user to become fully upright and thereby minimizes potential for walking failures. The said Rear Wheel Caster 116 is also situated at this height to make negotiating steps by the user possible. A third reason for this height is that the Rear Wheel Casters 116 are sufficiently low to the ground to easily position the instant invention for sitting.

In the present invention, the Rear Wheel Caster 116 is pivotally connected to the inferior plane of the Base Frame 110 at or near the posterior end of the said Base Frame 110. Said Rear Wheel Caster 116 has a spring and heavy brake pad within its housing. When the Rear Wheel Caster 116 makes contact with the ground and downward force is applied to the posterior end of the invention, the Rear Wheel Caster 116 pivots toward the posterior end of the said Frame 110 causing the Rear Wheel Caster 116 to make contact with a heavy brake pad, which prohibits the turning or spinning of the Rear Wheel Caster 116. The spring in the Rear Wheel Caster 116 housing cushions a harsh landing should the user fall backwards while using the present invention. The spring prevents a sudden stopping into the floor which can startle some users and the brake pad guarantees that the instant invention will not slide. This permits a softer seating which helps maintain a feeling of security for many patients, such as those recovering from strokes.

In the preferred embodiment the Center Wheel Casters 114 and the Front Wheel Casters 112 are both eight inches in diameter. The said Front Wheel Casters 112 swivel to allow the present invention to be steered and turned by the user during operation of the invention. The said Center Wheel Casters 114 do not swivel. Said Center Wheel Casters 114 are affixed to the inferior plane of the said Base Frame 110 so that the centers of said Center Wheel Casters 114 are aligned at fifteen and three-quarter inches from the front edge of the said Base Frame 110. This distance satisfies the requirement to have the centers of the said Center Wheel Casters 114 to be directly under the user's hip.

On the superior plane of said Base Frame 110 two risers, one anterior and one posterior are affixed perpendicularly to said Base Frame. The Anterior Riser 132 and Posterior Riser 134 are hollow tubes which allow the insertion and mounting of telescoping inserts. The Anterior Riser 132 and Posterior Riser 134 are supportably connected by a short connector tube or rod near the superior ends of said Anterior Riser 132 and Posterior Riser 134. Said connector tube is attached to the anterior plane of said Posterior Riser 134 and to the posterior plane of said Anterior Riser 132. A diagonal Support Bar 136 is affixed to the anterior plane of said Anterior Riser 132 and the superior plane of said Base Frame 110 as shown in FIG. 1.

An Anterior Telescoping Insert 130 is shaped to mate with and be inserted into said Anterior Riser 132. A Posterior Telescoping Insert 122 is shaped to mate with and be inserted into said Posterior Riser 134. A Handle 124 is affixed to the superior end of said Anterior Telescoping Insert 130. The Handle is designed to be gripped by the user to operate the present invention. Said Anterior Telescoping Insert 130 is bent inward toward the user at the superior end of said Anterior Telescoping Insert 130 as shown in FIG. 1. The inward bend of said Anterior Telescoping Insert 130 facilitates the user in sustaining the natural distance of the arm from the body during walking and also aids in comfort for the user in operating the present invention. The angle is critical for allowing the user to "scoop" his hands to operate the instant invention.

Both the Anterior Telescoping Insert 130 and the Posterior Telescoping Insert 122 are constructed to have sequential notches, grooves, or holes to allow the user to adjust the height of the telescoping inserts. In the present embodiment of the invention, said Anterior Telescoping Insert 130 and the Posterior Telescoping Insert 122 have three-fifth inch adjustment increments. The close increment is not common to other walking devices present in the prior art. This close increment is used because the heights of said Anterior Telescoping Insert 130 and the Posterior Telescoping Insert 122 affect positively the operation of the present invention by the user.

Brake Levers 126 are mounted upon said Handles 124 which may be gripped and operated by the user during normal operation of the present invention. In the present embodiment of the invention, said Brake Levers 126 are mechanically coupled to said Center Wheel Casters 114 by means of a Brake Cable 120. When a user operates or squeezes said Brake Levers 126, brakes on said Center Wheel Casters 114 are engaged so as to render the present invention unable to roll or move until said Brake Levers 126 are released.

The height at which said Anterior Telescoping Insert 130 is adjusted relative to said Anterior Riser 132 predisposes the height of the Handles 124. The desired height of the said Handles 124 is determined primarily by the user's height and arm length and therefore is independently adjustable from said Posterior Telescoping Insert 122. It is imperative to adjust the height of said Handles 124 based upon the height and arm length of the user because this height situates the user's arms at the correct length for the user to scoop his grip onto the said Handles 124 and consequently be able to draw himself upright as the said Center Wheel Casters 114 rock or roll forward.

A U-shaped Bumbar 118 is releasably attached to the superior ends of said Posterior Telescoping Inserts 122. The desired height of the said Bumbar 118 is determined primarily by the user's leg length and therefore is independently adjustable from said Anterior Telescoping Insert 130. The adjustable height of said Posterior Telescoping Insert 122 and said Bumbar 118 affects the distance of the said Bumbar 118 from the user's body. When said Bumbar 118 is detached from said Posterior Telescoping Inserts 122, the present invention may be disassembled for convenient transportation or storage.

Said Anterior Riser 132 and said Posterior Riser 134 are constructed to include Fastening Nuts 128 which tighten through pre-bored holes and tighten into the telescoping inserts. Through operation of said Fastening Nuts 128, said Anterior Telescoping Insert 130 and said Posterior Telescoping Insert 122 can be adjusted to the desired heights and secured into place as the Fastening Nuts 128 engage the notches, holes or grooves constructed into said Anterior Telescoping Insert 130 and said Posterior Telescoping Insert 122, as discussed in paragraph 24. In the present embodiment of the invention, said Fastening Nuts 128 comprise locking spring plungers with trinity knobs which are designed for users who have difficulty with dexterity because they have three deeply cut scallops with beveled edges for comfortable use.

In the present embodiment of the invention, said Base Frame 110, Bumbar 118, Posterior Riser 134, Posterior Telescoping Insert 122, Anterior Riser 132, Anterior Telescoping Insert 130, and Diagonal Support Bar 136 are all constructed from a light weight metal such as aluminum. However, other light weight rigid materials may also be used.

We claim:

1. A balance and walking trainer for improving the ability to walk or relearning to walk, comprising:

a frame which defines a front, a rear, and an interior area in which a user may stand when walking when facing said front defined by a substantially U-shaped rear frame member configured to close off a rear frame side and open to said front;

the U-shaped rear frame member being connected to lateral frame members providing support for a plurality of wheels operably attached to the frame wherein the wheels are configured for rolling engagement with a ground surface;

one or more handles configured for gripping by a user at the front;

the plurality of wheels includes at least two posterior wheels configured in an elevated position above a ground surface and pivotally attached to the frame about a horizontal pivot point providing a safety feature;

wherein the posterior wheels contact the ground surface when the balance and walking trainer is tilted backwards to provide stabilization of the trainer and prevent tipping over in a rearward direction.

2. The balance and walking trainer of claim 1 wherein the lateral frame members extend substantially parallel to a forward walking direction of a user of the trainer for positioning to opposite lateral sides of the user.

3. The balance and walking trainer of claim 1 wherein said plurality of wheels comprise three pairs of wheels, a pair of anterior wheels being attached to an anterior portion of the frame, the at least two posterior wheels being attached to a posterior portion of the frame, and a third pair of wheels being mounted to the frame so that the third pair of wheels are centrally alignable with hips of the user during usage of the balance and walking trainer, one wheel of the pair of anterior wheels, one wheel of the at least two posterior wheels, and one wheel of the third pair of wheels being mounted on each of the lateral frame member.

4. The balance and walking trainer of claim 1 wherein the plurality of wheels comprises two anterior wheels, two center wheels, and the at least two posterior wheels, the two anterior wheels being adapted to swivel about a vertical axis so as to permit the user to steer the balance and walking trainer.

5. The balance and walking trainer of claim 4 wherein the at least two posterior wheels and the two center wheels are non-swiveling.

6. The balance and walking trainer of claim 4 wherein the two anterior wheels and the two center wheels have substantially identical diameters and the at least two posterior wheels have a smaller diameter compared to the diameters of the anterior and center wheels.

7. The balance and walking trainer of claim 6 wherein posterior portions of the lateral frame members are configured such that each of the at least two posterior wheels is elevated above a ground surface approximately 1.5 inches when the two anterior wheels and the two center wheels are in contact with the ground surface.

8. The balance and walking trainer of claim 7 wherein the at least two posterior wheels further comprise a means for braking which automatically engages when the at least two posterior wheels contact a ground surface to provide a braking force to the at least two posterior wheels should the user fall backwards or sit on the rear frame side causing the at least two posterior wheels to contact the ground surface.

9. The balance and walking trainer of claim 1 wherein the frame further comprises two anterior upright members and two posterior upright members, each of the upright members having an upper end and a lower end, the lower ends of the upright members being affixed to the lateral frame members such that the upright members have orientations perpendicular to the lateral frame members and perpendicular to a ground surface below the balance and walking trainer.

10. The balance and walking trainer of claim 9 wherein the anterior upright members are configured receive anterior telescoping insert members and the posterior upright members are configured to receive posterior telescoping insert members.

11. The balance and walking trainer of claim 10 wherein each said handle of the one or more handles is affixed to superior ends of the anterior telescoping insert members.

12. The balance and walking trainer of claim 11 wherein the anterior telescoping insert members bend inward relative to a centerline of the frame at or near the respective superior ends so that the handles for positioning the handles at or near natural resting positions of hands of the user.

13. The balance and walking trainer of claim 10 wherein the frame further comprises a means for securing the telescoping insert member at a desired height relative to a ground surface below the balance and walking trainer.

14. The balance and walking trainer of claim 1 further comprising brake levers disposed adjacent to the handles for providing a braking force to at least one wheel of the plurality of wheels, the brake levers being mechanically coupled to wheel brakes affixed to the at least one wheel of the plurality of wheels.

15. The balance and walking trainer of claim 14 wherein the at least one wheel on which the wheel brakes act is a center wheel.

16. The balance and walking trainer of claim 10 wherein the frame is constructed from lightweight metal.

* * * * *